US012692586B2

(12) United States Patent
Kim et al.

(10) Patent No.: US 12,692,586 B2
(45) Date of Patent: Jul. 28, 2026

(54) HOT DIP ALLOY COATED STEEL MATERIAL HAVING EXCELLENT ANTI-CORROSION PROPERTIES AND METHOD OF MANUFACTURING SAME

(71) Applicant: POSCO, Pohang-si (KR)

(72) Inventors: Heung-Yun Kim, Pohang-si (KR); Sung-Joo Kim, Gwangyang-si (KR)

(73) Assignee: POSCO, Pohang-si (KR)

( * ) Notice: Subject to any disclaimer, the term of this patent is extended or adjusted under 35 U.S.C. 154(b) by 0 days.

(21) Appl. No.: 17/786,263

(22) PCT Filed: Dec. 1, 2020

(86) PCT No.: PCT/KR2020/017386
§ 371 (c)(1),
(2) Date: Jun. 16, 2022

(87) PCT Pub. No.: WO2021/125625
PCT Pub. Date: Jun. 24, 2021

(65) Prior Publication Data

US 2023/0032557 A1 Feb. 2, 2023

(30) Foreign Application Priority Data

Dec. 18, 2019 (KR) ..... 10-2019-0169493

(51) Int. Cl.
*C23C 2/06* (2006.01)
*C21D 10/00* (2006.01)
(Continued)

(52) U.S. Cl.
CPC ..... *C23C 2/06* (2013.01); *C21D 10/005* (2013.01); *C23C 2/26* (2013.01); *C23C 2/29* (2022.08)

(58) Field of Classification Search
CPC ..... A61B 5/0077; A61B 5/015; A61B 5/1176; A61B 5/742; B23Q 15/12
See application file for complete search history.

(56) References Cited

U.S. PATENT DOCUMENTS 6,235,410 B1 * 5/2001 Komatsu ..... C23C 2/26 427/435
2014/0162087 A1 6/2014 Hoehn et al.
(Continued)

FOREIGN PATENT DOCUMENTS

AU 2010267413 B2 † 1/2011
CN 104630682 A 5/2015
(Continued)

OTHER PUBLICATIONS

JP-2004068075-A English translation. (Year: 2004).*
(Continued)

*Primary Examiner* — Hai Y Zhang
(74) *Attorney, Agent, or Firm* — Morgan Lewis & Bockius LLP

(57) ABSTRACT

An embodiment of the present disclosure provides a hot dip alloy coated steel material having high corrosion resistance, the hot dip alloy coated steel material including: a base steel sheet; and a hot dip alloy coating layer formed on the base steel sheet, wherein the hot dip alloy coating layer includes, by wt %, Al: from greater than 8% to 25%, Mg: from greater than 4% to 12%, and a balance of Zn and other inevitable impurities, wherein a surface of the hot dip alloy coating layer has a surface X-ray diffraction intensity satisfying Condition 1 below: [Condition 1] 2000 cps≤X-ray diffraction intensity≤20000 cps where the X-ray diffraction intensity refers to M−N, M refers to a greatest peak intensity within a 2θ range of 20.00° to lower than 21°, and N refers to a peak intensity at 2θ=20.00°.

2 Claims, 1 Drawing Sheet

(51) Int. Cl.
*C23C 2/26* (2006.01)
*C23C 2/28* (2006.01)

(56) References Cited

U.S. PATENT DOCUMENTS

| | | | | |
|---|---|---|---|---|
| 2018/0237897 | A1 * | 8/2018 | Hashimoto | C23C 2/06 |
| 2019/0010595 | A1 | 1/2019 | Oh et al. | |
| 2021/0010106 | A1 | 1/2021 | Kim et al. | |
| 2021/0147971 | A1 † | 5/2021 | Harada | |

FOREIGN PATENT DOCUMENTS

| | | | | |
|---|---|---|---|---|
| CN | 107429375 | A | | 12/2017 |
| EP | 0905270 | A2 | † | 3/1999 |
| EP | 2762583 | B1 | | 11/2018 |
| JP | H07-118876 | A | | 5/1995 |
| JP | H10-306357 | A | | 11/1998 |
| JP | H11-158656 | A | | 6/1999 |
| JP | 2001-295018 | A | | 10/2001 |
| JP | 2002-173753 | A | | 6/2002 |
| JP | 2004-68075 | A | † | 3/2004 |
| JP | 2004068075 | A | * | 3/2004 |
| JP | 2006-193791 | A | | 7/2006 |
| JP | 2012-214896 | A | | 11/2012 |
| JP | 2017-066457 | A | | 4/2017 |
| KR | 10-2014-0074231 | A | | 6/2014 |
| KR | 10-2017-0076924 | A | | 7/2017 |
| KR | 10-2019-0078509 | A | | 7/2019 |
| WO | 2011/001662 | A1 | | 1/2011 |
| WO | 2011_001662 | A1 | † | 1/2011 |
| WO | 2019/009003 | A1 | | 1/2019 |
| WO | 2019_009003 | A1 | † | 1/2019 |

OTHER PUBLICATIONS

Chinese Office Action dated Mar. 9, 2023 issued in Chinese Patent Application No. 202080089927.0.

Fang Fang et al., "Comparison of Phase Structure for Ga/Zn—Al—Mg Coated Auto Steel," Journal of Wuhan Engineering Institute, vol. 29. No. 3, Sep. 15, 2017 (with English Abstract).

Japanese Office Action dated Jul. 4, 2023 issued in Japanese Patent Application No. 2022-536981.

Extended European Search Report dated Nov. 8, 2022 issued in European Patent Application No. 20900818.4.

International Search Report dated Apr. 26, 2021 issued in International Patent Application No. PCT/KR2020/017386 (with English translation).

Chinese Office Action dated Sep. 29, 2023 issued in Chinese Patent Application No. 202080089927.0.

Takashi Ida, "How to Use Powder Diffraction Method (1)—Selection and Use of a Powder Diffractometer—," Journal of Flux Growth, vol. 3, No. 1, Dec. 31, 2008 (with English Abstract).

Takashi Ida, "How to Use Powder Diffraction Method (4)—Setting of Measurement—," Journal of Flux Growth , vol. 4, No. 2, Dec. 31, 2009 (with English Abstract).

* cited by examiner
† cited by third party

【Fig. 1】
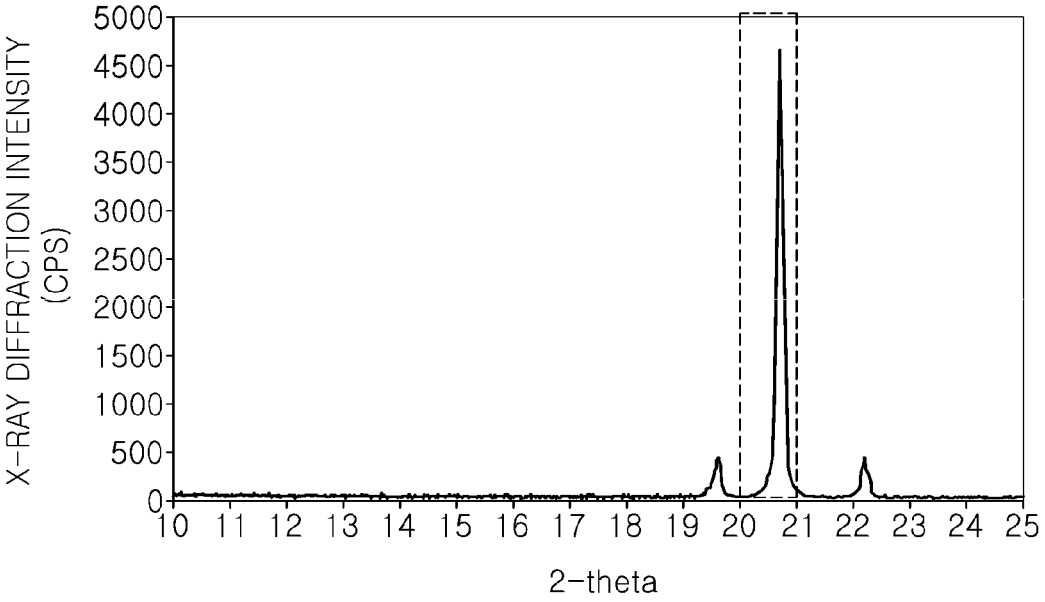
【Fig. 2】
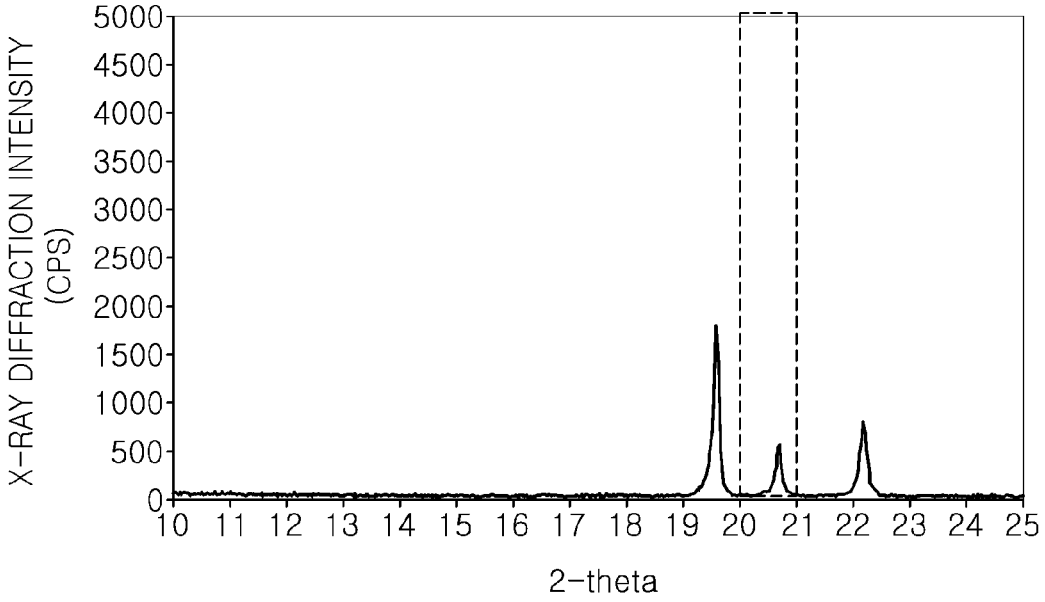

HOT DIP ALLOY COATED STEEL MATERIAL HAVING EXCELLENT ANTI-CORROSION PROPERTIES AND METHOD OF MANUFACTURING SAME

CROSS-REFERENCE OF RELATED APPLICATIONS

This application is the U.S. National Phase under 35 U.S.C. § 371 of International Patent Application No. PCT/KR2020/017386, filed on Dec. 1, 2020, which in turn claims the benefit of Korean Application No. 10-2019-0169493, filed on Dec. 18, 2019, the entire disclosures of which applications are incorporated by reference herein.

TECHNICAL FIELD

The present disclosure relates to a hot dip alloy coated steel material having high corrosion resistance and a method of manufacturing the hot dip alloy coated steel material.

BACKGROUND ART

Galvanized steel materials are protected from corrosion owing to: a sacrificial anticorrosive action in which zinc having a higher oxidation potential than a base steel sheet is oxidized prior to the base steel sheet; a corrosion inhibiting action in which a dense zinc corrosion product delays corrosion; and the like. Nevertheless, a lot of efforts have been made to improve corrosion resistance to cope with day-by-day worsening of corrosive environments and resource and energy saving requirements.

For example, a zinc-aluminum alloy coating in which 5 wt % or 55 wt % aluminum is added to zinc has been researched. However, although the zinc-aluminum alloy coating guarantees high corrosion resistance, the zinc-aluminum coating is disadvantageous in terms of long-term durability because aluminum dissolves more easily in alkaline conditions than zinc. In addition to the coating techniques described above, various alloy coating techniques have been researched.

Recently, as a result of these efforts, corrosion resistance has markedly improved by adding Mg to a coating bath. Patent Document 1 discloses a technique characterized by a Zn—Mg—Al alloy coating layer including Mg: 0.05% to 10.0%, Al: 0.1% to 10.0%, and a balance of Zn and inevitable impurities. However, this technique has a problem in that if a coarse coating structure is formed or a certain structure is intensively formed, the structure corrodes first.

In addition, Patent Document 2 discloses a technique for improving corrosion resistance by controlling the microstructure of a coating layer. This technique is characterized by a Zn—Al—Mg—Si coating layer having a metal structure in which a Mg2Si phase, a Zn2Mg phase, an Al phase, and a Zn phase are mixed with each other in an Al/Zn/Zn2Mg ternary eutectic structure. However, this technique is applicable only to high-strength steels containing Si and requires that Si must be included in a coating microstructure, thereby increasing costs for manufacturing ingots for coating, and making it difficult to manage processes.

Patent Document 3 discloses a technique of controlling an X-ray intensity ratio for uniform appearance. This technique is characterized in that the X-ray intensity ratio of Mg2Zn11/MgZn2 in a Zn alloy coating layer is 0.2 or less, and the size of an Al phase is 200 μm or less. However, these characteristics vary sensitively, according to material sizes, and thus it is difficult to manage processes.

Patent Document 4 discloses a technique for improving metal embrittlement cracking characteristics and coating film blister corrosion resistance. This technique is characterized in that the intensity of X-ray diffraction satisfies: A (diffraction peak)−B (background)≤400 cps. However, a problem with this technique is insufficient corrosion resistance.

PRIOR ART DOCUMENTS (Patent Document 1) Japanese Patent Application Laid-Open Publication No. 1999-158656
(Patent Document 2) Japanese Patent Application Laid-Open Publication No. 2001-295018
(Patent Document 3) Japanese Patent Application Laid-Open Publication No. 2006-193791
(Patent Document 4) Japanese Patent Application Laid-Open Publication No. 2012-214896

DISCLOSURE

Technical Problem

An aspect of the present disclosure may provide a hot dip alloy coated steel material having high corrosion resistance and a method of manufacturing the hot dip alloy coated steel material.

Technical Solution

According to an aspect of the present disclosure, a hot dip alloy coated steel material having high corrosion resistance may include: a base steel sheet; and a hot dip alloy coating layer formed on the base steel sheet, wherein the hot dip alloy coating layer may include, by wt %, Al: from greater than 8% to 25%, Mg: from greater than 4% to 12%, and a balance of Zn and other inevitable impurities, wherein a surface of the hot dip alloy coating layer may have an X-ray diffraction intensity satisfying Condition 1 below:

$$2000 \text{ cps} \leq \text{X-ray diffraction intensity} \leq 20000 \text{ cps} \qquad \text{[Condition 1]}$$

where the X-ray diffraction intensity refers to M−N, M refers to the greatest peak intensity within a 2θ range of 20.00° to lower than 21°, and N refers to a peak intensity at 2θ=20.00°.

According to another aspect of the present disclosure, a method of manufacturing a hot dip alloy coated steel material having high corrosion resistance may include: preparing a base steel sheet; hot dip coating the base steel sheet by passing the base steel sheet through a coating bath including, by wt %, Al: from greater than 8% to 25%, Mg: from greater than 4% to 12%, and a balance of Zn and other inevitable impurities; and gas wiping and cooling the hot dip coated base steel sheet to form a hot dip alloy coating layer on the base steel sheet, wherein the cooling may include: a first process of applying a first gas having a volume ratio of oxygen/nitrogen within a range of 0.18 to 0.34; a second process of applying a second gas having a volume ratio of nitrogen to all gases excluding nitrogen within a range of 10 to 10000; and a third process of applying laser shock waves to the hot dip alloy coating layer.

Advantageous Effects

According to an aspect of the present disclosure, a hot dip alloy coated steel material having high corrosion resistance and a method of manufacturing the hot dip alloy coated steel material may be provided, and thus the lifespan of structures may be increased in harsh corrosive environments such as seawater or corrosive gas.

DESCRIPTION OF DRAWINGS

FIG. 1 is a graph illustrating the X-ray diffraction intensity of Inventive Example 7 with respect to an X-ray diffraction detection angle (2θ).

FIG. 2 is a graph illustrating the X-ray diffraction intensity of Comparative Example 1 with respect to an X-ray diffraction detection angle (2θ).

BEST MODE

Hereinafter, a hot dip alloy coated steel material having high corrosion resistance will be described according to an embodiment of the present disclosure.

The hot dip alloy coated steel material of the present disclosure includes: a base steel sheet; and a hot dip alloy coating layer formed on the base steel sheet.

In the present disclosure, the type of the base steel sheet is not particularly limited, and for example, the base steel sheet may be a steel sheet such as a hot-rolled steel sheet, a hot-rolled pickled steel sheet, or a cold-rolled steel sheet; a wire rod; or a steel wire. In addition, the base steel sheet of the present disclosure may have any composition which is classified as a steel material.

The hot dip alloy coating layer may preferably include, by wt %, Al: from greater than 8% to 25%, Mg: from greater than 4% to 12%, and a balance of Zn and other inevitable impurities. Al stabilizes Mg when preparing a molten metal and serves as a corrosion barrier suppressing initial corrosion in a corrosive environment. When the content of Al is 8% or less, Mg is not stabilized in a molten metal preparing process, and thus Mg oxide is formed on the surface of the molten metal. When the content of Al exceeds 25%, there are problems in that the temperature of a coating bath increases, and various facilities installed on the coating bath are severely eroded. Therefore, the content of Al may preferably range from greater than 8% to 25%. More preferably, the lower limit of the content of Al may be 10%. More preferably, the upper limit of the content of Al may be 20%. Mg has a function of forming a microstructure having corrosion resistance. When the content of Mg is 4% or less, corrosion resistance is not sufficient. When the content of Mg exceeds 12%, the temperature of a coating bath increases, and Mg oxide is formed, which causes various problems such as deterioration in material characteristics and an increase in costs. Therefore, the content of Mg may preferably range from greater than 4% to 12%. More preferably, the lower limit of the content of Mg may be 5%. More preferably, the upper limit of the content of Mg may be 10%.

For stabilizing Mg, the hot dip alloy coating layer may further include at least one selected from the group consisting of Be, Ca, Ce, Li, Sc, Sr, V, and Y in a total amount of 0.0005% to 0.009%. When the content of the additional at least one alloying element is lower than 0.0005%, the effect of stabilizing Mg is not practically obtained. When the content of the additional at least one alloying element exceeds 0.009%, the solidification of the hot dip alloy coating layer occurs late, and preferential corrosion occurs, thereby deteriorating corrosion resistance and incurring costs. Therefore, the total content of at least one selected from the group consisting of Be, Ca, Ce, Li, Sc, Sr, V, and Y may preferably be within the range of 0.0005% to 0.009%. More preferably, the lower limit of the total content of the additional at least one alloying element may be 0.003%. More preferably, the upper limit of the total content of the additional at least one alloying element may be 0.008%.

The X-ray diffraction intensity of a surface of the hot dip alloy coating layer may preferably satisfy Condition 1 below. In this case, the X-ray diffraction intensity refers to M−N, where M refers to the greatest peak intensity within a 2θ range of 20.00° to lower than 21°, and N refers to the peak intensity at 2θ=20.00°. That is, in the present disclosure, X-ray diffraction intensity refers to a value obtained by subtracting the peak intensity at 2θ=20.00° from the greatest peak intensity within the 2θ range of 20.00° to lower than 21°. When the X-ray diffraction intensity is lower than 2000 cps, MgZn2 phase may be insufficient, and thus corrosion resistance may be insufficient. When the X-ray diffraction intensity exceeds 20000 cps, metal brittleness may be high, and thus workability may be poor. Therefore, the X-ray diffraction intensity may preferably be within the range of 2000 cps to 20000 cps. More preferably, the lower limit of the surface X-ray diffraction intensity may be 2500 cps, and even more preferably 3000 cps. Preferably, the upper limit of the surface X-ray diffraction intensity may be 12000 cps.

$$2000\ \text{cps} \leq \text{X-ray diffraction intensity} \leq 20000\ \text{cps} \qquad \text{[Condition 1]:}$$

The hot dip alloy coating layer may include various solidification phases, and for example, the hot dip alloy coating layer may include a single phase, a binary eutectic phase, a ternary eutectic phase, or an intermetallic compound, which contains Mg, Al, Zn, and other additional alloying elements. The intermetallic compound may include MgZn2, Mg2Zn11, or the like.

Hereinafter, a method of manufacturing a hot dip alloy coated steel material having high corrosion resistance will be described according to an embodiment of the present disclosure.

First, a base steel sheet is prepared. When preparing the base steel sheet, the surface of the base steel sheet may be cleaned by removing foreign substances such as oil from the surface of the base steel sheet through a degreasing, cleaning, or pickling process.

Thereafter, before hot dip coating, the base steel sheet may be subjected to a heat treatment process that is normally performed in the art. Therefore, in the present disclosure, conditions of the heat treatment process are not particularly limited. However, for example, the heat treatment process may be performed at a temperature of 400° C. to 900° C. In addition, for example, hydrogen, nitrogen, oxygen, argon, carbon monoxide, carbon dioxide, moisture, or the like may be used as a gas atmosphere. For example, a gas atmosphere including 5 vol % to 20 vol % hydrogen gas and 80 vol % to 95 vol % nitrogen gas may be used.

Thereafter, the base steel sheet is hot dip coated by passing the base steel sheet through a coating bath containing, by wt %, Al: from greater than 8% to 25%, Mg: from greater than 4% to 12%, and a balance of Zn and other inevitable impurities. The coating bath may further include at least one selected from the group consisting of Be, Ca, Ce, Li, Sc, Sr, V, and Y in a total amount of 0.0005% to 0.009%. In the present disclosure, the temperature of the coating bath is not particularly limited. The temperature of the coating bath may be set to be a coating bath temperature common in the art, for example, a temperature ranging from 400° C. to 550° C.

Thereafter, the hot dip coated base steel sheet is gas wiped and cooled to form a hot dip alloy coating layer on the base steel sheet. The gas wiping is performed to control the amount of coating such that the hot dip alloy coating layer may have an intended thickness. Furthermore, in the present disclosure, the cooling is performed through three processes described below, and thus the hot dip alloy coating layer may have an X-ray diffraction intensity as intended in the present disclosure. If the cooling does not conform to the following three processes, there are problems such as a low X-ray diffraction intensity, insufficient corrosion resistance, a poor working environment, an increase in manufacturing costs, and an increase in surface defects.

First, a first process is performed by applying a first gas having a volume ratio of oxygen/nitrogen within the range of 0.18 to 0.34. If the volume ratio of oxygen/nitrogen is lower than 0.18, manufacturing costs increase, and when the volume ratio of oxygen/nitrogen exceeds 0.34, surface defects are formed. More preferably, the lower limit of the volume ratio of oxygen/nitrogen may be 0.19. More preferably, the upper limit of the volume ratio of oxygen/nitrogen may be 0.28. In addition, although it is preferable that the first gas contains only oxygen and nitrogen, the first gas may further include, in addition to oxygen and nitrogen, an impurity gas in an amount of 0.5 vol % or less. This amount of impurity gas does not affect the effects intended in the present disclosure. The impurity gas may include at least one selected from the group consisting of argon, carbon dioxide, carbon monoxide, and moisture.

Meanwhile, in the first process, the first gas may be a flow rate of 0.5 $m^3$/min to 5 $m^3$/min.

Thereafter, a second process is performed by applying a second gas having a volume ratio of nitrogen to all gases excluding nitrogen within the range of 10 to 10000. If the volume ratio of nitrogen to all gases excluding nitrogen is lower than 10, manufacturing costs increase, and if the volume ratio of nitrogen to all gases excluding nitrogen exceeds 10000, surface defects are formed. More preferably, the lower limit of the volume ratio of nitrogen to all gases excluding nitrogen may be 20. More preferably, the upper limit of the volume ratio of nitrogen to all gases excluding nitrogen may be 2000. In addition to nitrogen, the second gas may include at least one selected from the group consisting of oxygen, moisture, argon, carbon dioxide, and carbon monoxide.

Meanwhile, in the second process, the second gas may be a flow rate of 2 $m^3$/min to 20 $m^3$/min.

Thereafter, a process of applying laser shock waves to the hot dip alloy coating layer is performed. Laser shock waves is applied to form fine wrinkles having sizes in micrometers on the surface of the hot dip alloy coating layer. In the present disclosure, conditions for applying laser shock waves are not particularly limited as long as the above-mentioned effect is obtainable. However, for example, laser shock waves having a pulse rate of 20 P/sec to 100 P/set and a power of 20 W to 1000 W may be applied.

MODE FOR INVENTION

Hereinafter, the present disclosure will be described in more detail through examples. However, it should be noted that the following examples are for more specifically illustrating the present disclosure, and are not intended to limit the scope of the present disclosure. The scope of the present disclosure is determined by the following claims and equivalents reasonably inferred therefrom.

EXAMPLES

Low-carbon cold-rolled steel sheets having a thickness of 0.8 mm were prepared, degreased, and heat treated at 800° C. under a reducing atmosphere including 10 vol % hydrogen and 90 vol % nitrogen. Thereafter, the heat-treated steel sheets, that is, base steel sheets, were hot dip coated by immersing the base steel sheets in alloy coating baths at 450° C., and the amount of coating on each of the base steel sheets was controlled by gas wiping to obtain hot dip alloy coating layers having a thickness of about 10 μm. Thereafter, cooling was performed under the conditions shown in Table 1 below to fabricate hot dip alloy coated steel materials. At that time, laser shock waves were applied under the conditions of 100 P/sec and 20 W. In addition, the alloy coating baths had compositions as shown in Table 2 below. The compositions of the hot dip alloy coating layers of the hot dip alloy coated steel materials prepared as described above were measured, and results thereof are shown in Table 2 below. In addition, the surfaces of the hot dip alloy coating layers were analyzed by XRD to measure X-ray diffraction intensities, and results are shown in Table 2 below. At that time, the X-ray diffraction intensities were measured with D/MAX-2200/PC (by RIGAKU Cooperation) under the conditions of Cu target, voltage: 40 kV, current: 40 mA, and X-ray diffraction detection angle (2θ): 10° to 100°. In addition, the coatability, corrosion resistance, and workability of each of the hot dip alloy coated steel materials were evaluated, and results thereof are shown in Table 2 below.

Coatability was evaluated by the amount of dross formed in the coating baths. Here, the term "dross" refers to fine solid particles present in a liquid coating bath, and as the amount of dross increases, more surface defects are formed because the dross adheres to the surface of a steel material.

○: No surface defects caused by dross

X: Surface defects caused by dross

A salt spray test was performed on the hot dip alloy coated steel materials, and then a time period was measured until red rust occurred, so as to evaluate corrosion resistance based on time to red rust occurrence (Hr)/coating amount (g/$m^2$). At that time, the salt spray test was performed under the conditions of salinity: 5%, temperature: 35° C., pH: 6.8, and salt spray amount: 2 ml/80 $cm^2$·1 Hr.

○: Time to red rust occurrence (Hr)/coating amount (g/$m^2$) 40 or more

X: Time to red rust occurrence (Hr)/coating amount (g/$m^2$) lower than 40

Workability was evaluated by bending each hot dip alloy coated steel material to a radius of curvature of 0.4 mm and observing the size of cracks in the outer surface of the hot dip alloy coated steel material.

○: when the average crack size is lower than 30 μm

X: when the average crack size exceeds 30 μm

TABLE 1

| Examples | First process Volume ratio of oxygen/nitrogen | Second process Volume ratio of nitrogen to all gases excluding nitrogen | Third process Application of laser shock waves |
|---|---|---|---|
| Inventive Examplel | 0.25 | 2430 | ○ |
| Inventive Example 2 | 0.29 | 560 | ○ |
| Inventive Example 3 | 0.21 | 6520 | ○ |
| Inventive Example 4 | 0.19 | 320 | ○ |
| Inventive Example 5 | 0.29 | 2250 | ○ |

TABLE 1-continued

| Examples | First process Volume ratio of oxygen/nitrogen | Second process Volume ratio of nitrogen to all gases excluding nitrogen | Third process Application of laser shock waves |
|---|---|---|---|
| Inventive Example 6 | 0.33 | 8740 | ○ |
| Comparative Example 1 | 0.24 | 650 | ○ |
| Comparative Example 2 | 0.27 | 77 | ○ |
| Inventive Example 7 | 0.27 | 2520 | ○ |
| Inventive Example 8 | 0.23 | 850 | ○ |
| Comparative Example 3 | 0.23 | 3820 | ○ |
| Inventive Example 9 | 0.24 | 2360 | ○ |
| Inventive Example 10 | 0.19 | 3380 | ○ |
| Inventive Example 11 | 0.26 | 1860 | ○ |
| Inventive Example 12 | 0.30 | 2930 | ○ |
| Inventive Example 13 | 0.24 | 3570 | ○ |
| Inventive Example 14 | 0.27 | 5510 | ○ |
| Inventive Example 15 | 0.23 | 2130 | ○ |
| Inventive Example 16 | 0.27 | 1050 | ○ |
| Inventive Example 17 | 0.18 | 10 | ○ |
| Inventive Example 18 | 0.34 | 10000 | ○ |
| Comparative Example 4 | 0.15 | 8 | X |
| Comparative Example 5 | 0.35 | 12350 | ○ |
| Comparative Example 6 | 0.26 | 1240 | X |

TABLE 2

| Examples | Composition (wt %) Al | Mg | others | XRD intensity (cps) | Coatability | Corrosion resistance | Workability |
|---|---|---|---|---|---|---|---|
| Inventive Example 1 | 12 | 5 | — | 4080 | ○ | ○ | ○ |
| Inventive Example 2 | 18 | 8 | — | 12608 | ○ | ○ | ○ |
| Inventive Example 3 | 20 | 10 | — | 7823 | ○ | ○ | ○ |
| Inventive Example 4 | 16 | 6 | — | 2403 | ○ | ○ | ○ |
| Inventive Example 5 | 8 | 4 | — | 2000 | ○ | ○ | ○ |
| Inventive Example 6 | 25 | 12 | — | 20000 | ○ | ○ | ○ |
| Comparative Example 1 | 6 | 3 | — | 443 | ○ | X | ○ |
| Comparative Example 2 | 20 | 14 | — | 35264 | X | ○ | X |
| Inventive Example 7 | 12 | 5 | Li: 0.0005 | 4602 | ○ | ○ | ○ |
| Inventive Example 8 | 12 | 5 | Li: 0.0090 | 3585 | ○ | ○ | ○ |
| Comparative Example 3 | 12 | 5 | Li: 0.0500 | 742 | ○ | X | ○ |
| Inventive Example 9 | 12 | 5 | Ca: 0.0090 | 4357 | ○ | ○ | ○ |

TABLE 2-continued

| Examples | Composition (wt %) Al | Mg | others | XRD intensity (cps) | Coatability | Corrosion resistance | Workability |
|---|---|---|---|---|---|---|---|
| Inventive Example 10 | 12 | 5 | Ce: 0.0090 | 3045 | ○ | ○ | ○ |
| Inventive Example 11 | 12 | 5 | Be: 0.0090 | 3773 | ○ | ○ | ○ |
| Inventive Example 12 | 12 | 5 | Sc: 0.0090 | 9962 | ○ | ○ | ○ |
| Inventive Example 13 | 12 | 5 | V: 0.0090 | 5507 | ○ | ○ | ○ |
| Inventive Example 14 | 12 | 5 | Y: 0.0090 | 7850 | ○ | ○ | ○ |
| Inventive Example 15 | 12 | 5 | | 4187 | ○ | ○ | ○ |
| Inventive Example 16 | 12 | 5 | | 7178 | ○ | ○ | ○ |
| Inventive Example 17 | 12 | 5 | | 2287 | ○ | ○ | ○ |
| Inventive Example 18 | 12 | 5 | | 16193 | ○ | ○ | ○ |
| Comparative Example 4 | 12 | 5 | | 1037 | ○ | X | ○ |
| Comparative Example 5 | 12 | 5 | | 25642 | ○ | ○ | X |
| Comparative Example 6 | 12 | 5 | | 1712 | ○ | X | ○ |

X-ray diffraction (XRD) intensity = M − N, where M refers to the greatest peak intensity within a 2θ range of 20.00° to lower than 21°, and N refers to the peak intensity at 2θ = 20.00°

As shown in Tables 1 and 2 above, Inventive Examples 1 to 18, in which the hot dip alloy coating layers satisfy the composition, X-ray diffraction intensity, and manufacturing conditions proposed in the present disclosure, have high coatability and high workability in addition to having high corrosion resistance.

Comparative Example 1, in which the hot dip alloy coating layer does not satisfy the Al and Mg contents proposed in the present disclosure, has an X-ray diffraction intensity lower than the range proposed in the present disclosure and poor corrosion resistance.

Comparative Example 2, in which the hot dip alloy coating layer does not satisfy the Mg content proposed in the present disclosure, has an X-ray diffraction intensity greater than the range proposed in the present disclosure, and poor coatability and poor workability.

Comparative Example 3, in which the hot dip alloy coating layer does not satisfy the Li content proposed in the present disclosure, has an X-ray diffraction intensity lower than the range proposed in the present disclosure and poor corrosion resistance.

Comparative Example 4, which does not satisfy the conditions of the first to third processes among the manufacturing conditions proposed in the present disclosure, has an X-ray diffraction intensity lower than the range proposed in the present disclosure and poor corrosion resistance.

Comparative Example 5, which does not satisfy the conditions of the first and second processes among the manufacturing conditions proposed in the present disclosure, has an X-ray diffraction intensity greater than the range proposed in the present disclosure and poor workability.

Comparative Example 6, which does not satisfy the conditions of the third process among the manufacturing conditions proposed in the present disclosure, has an X-ray diffraction intensity lower than the range proposed in the present disclosure and poor corrosion resistance.

FIG. 1 is a graph illustrating the X-ray diffraction intensity of Inventive Example 7 with respect to an X-ray diffraction detection angle (2θ), FIG. 2 is a graph illustrating the X-ray diffraction intensity of Comparative Example 1 with respect to an X-ray diffraction detection angle (2θ). As shown in FIGS. 1 and 2, the X-ray diffraction intensity of Inventive Example 7 satisfies the condition of the present disclosure, but the X-ray diffraction intensity of Comparative Example 1 is very low.

The invention claimed is:

1. A hot dip alloy coated steel material comprising:

a base steel sheet; and a hot dip alloy coating layer formed on the base steel sheet, wherein the hot dip alloy coating layer comprises, by wt %, Al: 12% to 25%, Mg: 6% to 12%, and a balance of Zn and other inevitable impurities, wherein a surface of the hot dip alloy coating layer has an X-ray diffraction intensity satisfying Condition 1 below:

$$2000 \text{ cps} \leq \text{X-ray diffraction intensity} \leq 20000 \text{ cps} \quad \text{[Condition 1]}$$

where the X-ray diffraction intensity refers to M-N, M refers to a greatest peak intensity within a 2θ range of 20.00° to lower than 21°, and N refers to a peak intensity at 2θ=20.00°.

2. The hot dip alloy coated steel material of claim 1, wherein the hot dip alloy coating layer further comprises at least one selected from the group consisting of Be, Ca, Ce, Li, Sc, Sr, V, and Y in a total amount of 0.0005% to 0.009%.

* * * * *